United States Patent [19]

Rogers et al.

[11] Patent Number: 4,983,792

[45] Date of Patent: Jan. 8, 1991

[54] INTERRUPTER SWITCH WITH SELECTIVE CIRCUIT-ISOLATING FEATURE

[75] Inventors: Edward J. Rogers, Chicago; Leonard V. Chabala, Maywood; Joel A. Ramos, Chicago, all of Ill.

[73] Assignee: S&C Electric Company, Chicago, Ill.

[21] Appl. No.: 331,216

[22] Filed: Mar. 30, 1989

[51] Int. Cl.[5] ..... H01H 33/42; H01H 33/70

[52] U.S. Cl. ..... 200/148 F; 200/148 R; 200/148 A; 200/148 B

[58] Field of Search ..... 200/148 R, 148 F, 144 C, 200/148 A, 148 B

[56] References Cited

U.S. PATENT DOCUMENTS

| | | | |
|---|---|---|---|
| Re. 27,625 | 4/1973 | Weston | 200/48 SB |
| 2,529,145 | 11/1950 | Fernier | 200/148 F |
| 2,658,976 | 11/1953 | Hoye | 200/145 |
| 4,202,591 | 5/1980 | Borgstrom | 200/144 C |
| 4,596,906 | 6/1986 | Chabala et al. | 200/48 R |
| 4,752,859 | 6/1988 | Chabala et al. | 361/333 |

OTHER PUBLICATIONS

IEEE Paper C 74 107-7, "High Voltage Isolating Circuit Breakers Using Vacuum Interrupters".

*Primary Examiner*—Robert S. Macon
*Attorney, Agent, or Firm*—James V. Lapacek

[57] ABSTRACT

An interrupter switch is provided that includes an interrupter housing that is integrally formed from insulating material. The interrupter housing defines structure to house the interrupting contacts and the operating linkage for the interrupting contacts. The interrupter housing is selectively movable after circuit interruption to perform a visible, circuit-isolating function; the interrupter housing functioning as a movable switching member and carrying a disconnect contact that cooperates with a stationary disconnect contact at a first circuit terminal. A second circuit terminal is defined at a swivel or hinge contact carried by the interrupter housing. The interrupting contacts are connected between the movable disconnect contact and the second circuit terminal. The operating linkage includes a rotatable operating member which extends from the interrupter housing. The interrupter housing is filled with an insulating gas. Seals are provided between the interrupter housing and the operating member. The interrupter housing is rotatable about a predetermined axis through the first portion to perform the circuit-isolating, disconnect function. In a multi-pole arrangement in an electrical power distribution circuit, a plurality of circuit interrupters are provided with a common circuit-interrupter drive train and a common disconnect drive linkage. An arrangement is provided to ensure that the circuit interrupter is operated to open the interrupting contacts before the selective circuit-isolating function is provided. Also in the preferred arrangement, the integrally molded interrupter housing defines a pump cylinder for cooperation with the movable interrupting contact which carries a puffer piston.

18 Claims, 3 Drawing Sheets

INTERRUPTER SWITCH WITH SELECTIVE CIRCUIT-ISOLATING FEATURE

BACKGROUND OF THE INVENTION

1. Field of the Invention

The present invention relates generally to the field of electrical switches and circuit interrupters, and more particularly to a switch useful in electrical power distribution systems that includes an improved circuit interrupter. that is selectively operable to provide an additional circuit-isolating function after circuit-interruption operation.

2. Description of the Related Art

Various circuit interrupters are known in the prior art, as disclosed, for example, in the following U.S. Pat. Nos. Re. 27,625; 4,596,906; and 4,752,859. An arrangement similar to that of U.S. Pat. No. Re. 27,625 is disclosed in IEEE Paper C74 170-7.

While the above-described arrangements provide useful circuit interrupting and/or isolating functions, there is a need for a simplified circuit interrupter that provides a selective circuit-isolation feature subsequent to circuit interruption.

SUMMARY OF THE INVENTION

Accordingly, it is a principal object of the present invention to provide an interrupter switch having a circuit interrupter which is efficiently arranged to interrupt a circuit and which is selectively operable thereafter to additionally isolate the circuit via a disconnect function provided by movement of the overall housing for the circuit interrupter.

It is another object of the present invention to provide an interrupter switch having an interrupter housing that is capable of efficient manufacture and that is selectively movable to provide a circuit-isolating function.

It is a further object of the present invention to provide a circuit interrupter including an integrally formed insulating housing that houses the interrupting contacts and that is movable to provide a disconnect function.

It is yet another object of the present invention to provide an interrupter switch including an insulating interrupter housing that functions as a switching member and which is movable to provide a circuit-isolating function.

These and other objects of the present invention are efficiently achieved by an interrupter switch that includes an interrupter housing that is integrally formed from insulating material. The interrupter housing defines structure to house the interrupting contacts and the operating linkage for the interrupting contacts. The interrupter housing is selectively movable after circuit interruption to perform a visible, circuit-isolating function; the interrupter housing functioning as a movable switching member and carrying a disconnect contact that cooperates with a stationary disconnect contact at a first circuit terminal. A second circuit terminal is defined at a swivel or hinge contact carried by the interrupter housing. The interrupting contacts are connected between the movable disconnect contact and the second circuit terminal. In a preferred arrangement, the interrupter housing includes two portions. A first portion houses the operating linkage for the interrupter contacts. A second portion extends from said first portion and at a predetermined angle thereto. The second portion houses the interrupter contacts and functions as a switch member. The operating linkage includes a rotatable operating member which exits the first portion of the interrupter housing opposite the second portion. The interrupter housing is filled with an insulating gas. Seals are provided between the interrupter housing and the operating member. The interrupter housing is rotatable about a predetermined axis through the first portion to perform the circuit-isolating, disconnect function. In a multi-pole arrangement in an electrical power distribution circuit, a plurality of circuit interrupters are provided with a common circuit-interrupter drive train and a common disconnect drive linkage. An arrangement is provided to ensure that the circuit interrupter is operated to open the interrupting contacts before the selective circuit-isolating function is provided. Also in the preferred arrangement, the integrally molded interrupter housing defines a pump cylinder for cooperation with the movable interrupting contact which carries a puffer piston.

BRIEF DESCRIPTION OF THE DRAWING

The invention, both as to its organization and method of operation, together with further objects and advantages thereof, will best be understood by reference to the specification taken in conjunction with the accompanying drawing in which like reference characters refer to like elements and in which.

DETAILED DESCRIPTION

Figure 1:
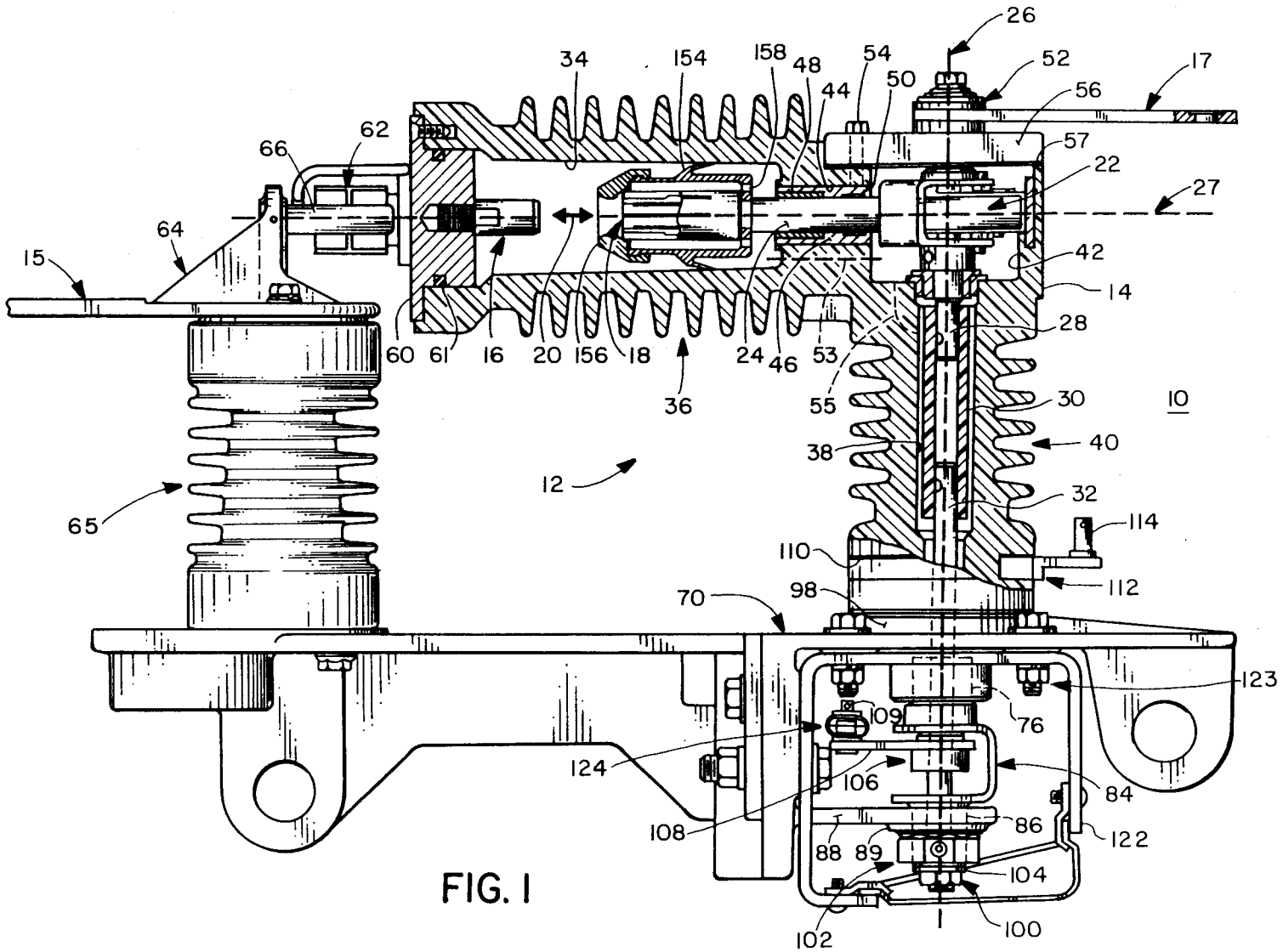
FIG. 1 is an elevational view, partly in section and with parts cut away for clarity, of an interrupter switch in accordance with the present invention.
Figure 2:
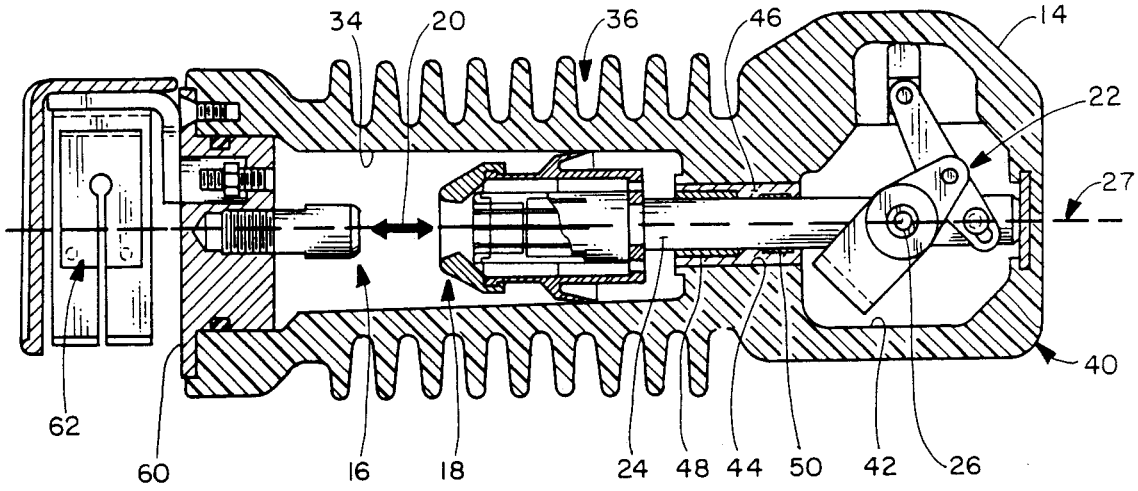
FIG. 2 is a sectional view of the interrupter switch of FIG. 1 taken generally along the line 1—1 of FIG. 1.
Figure 5:
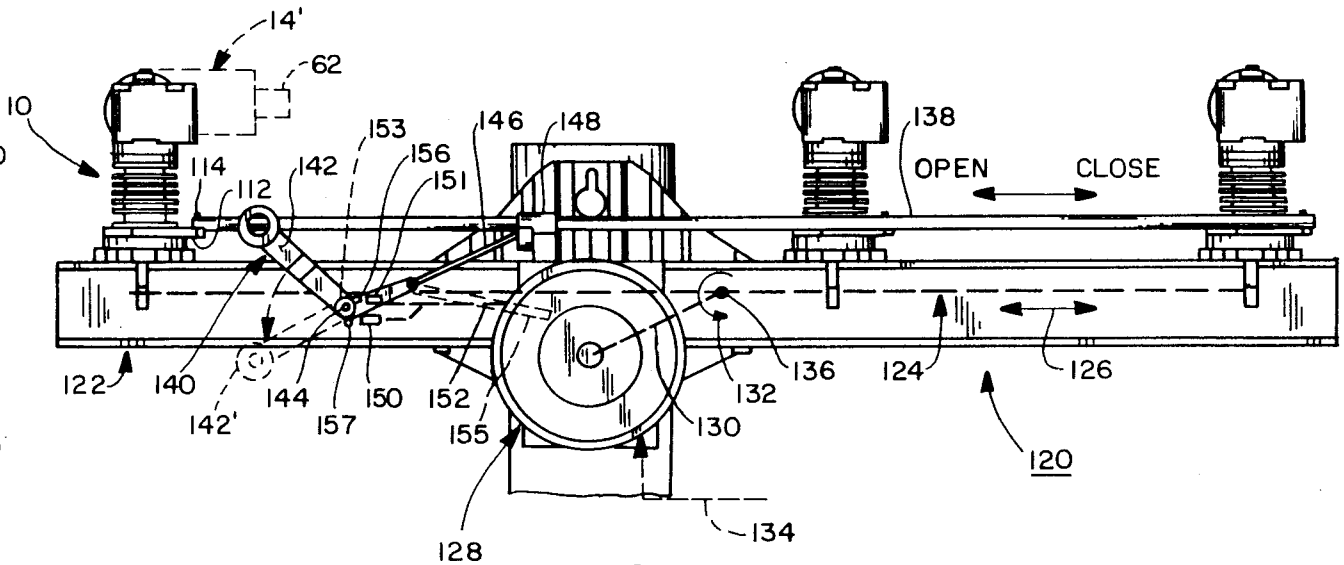
FIG. 5 is a perspective view of a three-pole group-operated interrupter switch configuration utilizing three of the interrupter switches of FIG. 1.

Referring now to FIGS. 1 and 2, the interrupter switch 10 of the present invention is useful in a variety of mounting configurations and orientations typically as one switch-pole of multi-pole group-operated interrupter switch configurations in electrical power distribution circuits. For example, as will be discussed in more detail hereinafter, one switch configuration is illustrated in FIG. 5. The interrupter switch 10 provides a circuit-interrupting function between circuit terminals 15,17 via operation of the separable interrupting contacts 16,18 of an interrupter 12.

Specifically, the interrupter 12 includes a housing 14 that is integrally formed of insulating material and that carries and houses the separable interrupting contacts including a movable contact 18 and a stationary contact 16. The movable contact 18 is movable along the path of bi-directional arrows 20 via an operating linkage generally referred to at 22. The operating linkage 22 is connected to the movable contact 18 via a contact rod 24 which is electrically conductive. The operating linkage 22 translates rotary motion about an axis 26 into translational motion along the path of the bi-directional arrows 20. Rotation about the axis 26 is provided via an input shaft 28 which is coupled via an insulative tube 30 to an operating member 32. It should be noted that the axis 26 of the operating member 32 and the axis 27 of the separable interrupting contacts 16,18 are aligned or coplanar so as to achieve efficiency of the molding of the interrupter housing 14.

The integrally formed interrupter housing 14 defines first portion 40 and a second portion 36 extending from said first portion 40 and at a predetermined angle thereto; e.g. generally perpendicular in the specific embodiment of FIG. 1. For clarity of description, the first portion 40 will be referred to hereinafter as the vertical portion 40 although it should be understood that in particular mounting configurations the portions of the interrupter housing 40 may assume any orientation including a horizontal orientation of the first portion 40. Similarly, the second portion 36 will be referred to hereinafter as the horizontal portion 36 for clarity. The interrupter housing 14 also includes: a first defined cavity or passageway 34 in the horizontal portion 36; a second defined passageway 38 which runs throughout the length of the vertical portion 40 in which the shaft 28, the operating member 32, and the tube 30 are disposed; and a third defined cavity 42 at the intersection of the horizontal portion 36 and the vertical portion 40 for housing the operating linkage 22. A sleeve bearing 33 and seal member 35 (FIGS. 3 and 4) are provided within the passageway 38 for cooperation with the operating member 32. The sleeve bearing 33 can be integrally formed with the interrupter housing 14 or affixed separately. A bore 44 communicates between the first defined cavity 34 and the third defined cavity 42. As seen in FIG. 2, a tubular conductive sleeve 46 is positioned within the bore 44 and carries a bearing 48 and a contact sleeve 50 which cooperate with the shaft 24. The contact sleeve 50 is preferably fabricated to define multiple contact laminations. Such an arrangement is available, for example, from Hugin Industries of Los Altos, Calif. The conductive sleeve 46 is electrically connected to a swivel contact generally referred to at 52 via a suitable electrically conductive path. For example, as illustrated in FIGS. 1 and 2, the electrically conductive path is provided by a screw 54 that passes through the conductive cover plate 56 and contacts the conductive sleeve 46. A seal 57 is provided between the cover plate 56 and the housing 14.

The stationary interrupting contact 16 is carried by an end plate 60 which closes the cavity 34. The stationary interrupting contact 16 is electrically connected to a jaw contact 62 via a suitable electrically conductive path. The jaw contact 62 is carried by the end plate 60. For example, as illustrated in FIGS. 1 and 2, the end plate 60 is conductive and electrically connects the jaw contact 62 and the stationary interrupting contact 16. A seal 61 is provided to seal the end plate 60 and the cavity 34 from the environment. The first circuit terminal 15 is generally defined at the terminal arrangement 64 that carries a stationary contact pin 66 for selective electrical connection with the jaw contact 62. As will be explained in more detail hereinafter, the jaw contact 62 and the contact pin 66 define a disconnect arrangement and are utilized to provide a circuit-isolating function. The terminal arrangement 64 is affixed to a support insulator 65 that is in turn affixed to the support base 70. In specific embodiments, the support insulator 65 is a circuit-parameter sensing arrangement as disclosed in copending application Ser. No. 331,311 filed in the names of Tobin, et.al. on Mar. 30, 1989.

Considering operation of the interrupter switch 10, upon appropriate of the operating member 32, the contacts 16,18 are separable and engageable to perform respective circuit connection and circuit interruption functions of the circuit path from the first circuit terminal 15 to the second circuit terminal 17 defined at the hinge contact 52. The interrupter switch 10 is thus operable via rotation of the operating member 32 in the counterclockwise direction in FIG. 2 to close the contacts 16,18 completing a circuit between the circuit terminals 15,17. Rotation of the operating member 32 in the clockwise direction will open the contacts 16,18, interrupting the circuit between the terminals 15,17. In accordance with important additional aspects of the present invention, the interrupter switch 10 is also capable of providing visible circuit isolation subsequent to the circuit interruption that is obtained by the separation of the contacts 16,18. To this end, the interrupter housing 14 is rotatably mounted with respect to the support base 70. When it is desired to provide visible circuit isolation subsequent to circuit interruption, the housing 14 is rotated about the axis 26 so as to move the horizontal portion 36 a suitable distance for separation of the disconnect contacts 62,66 in accordance with the desired visible air break.

Figure 3:
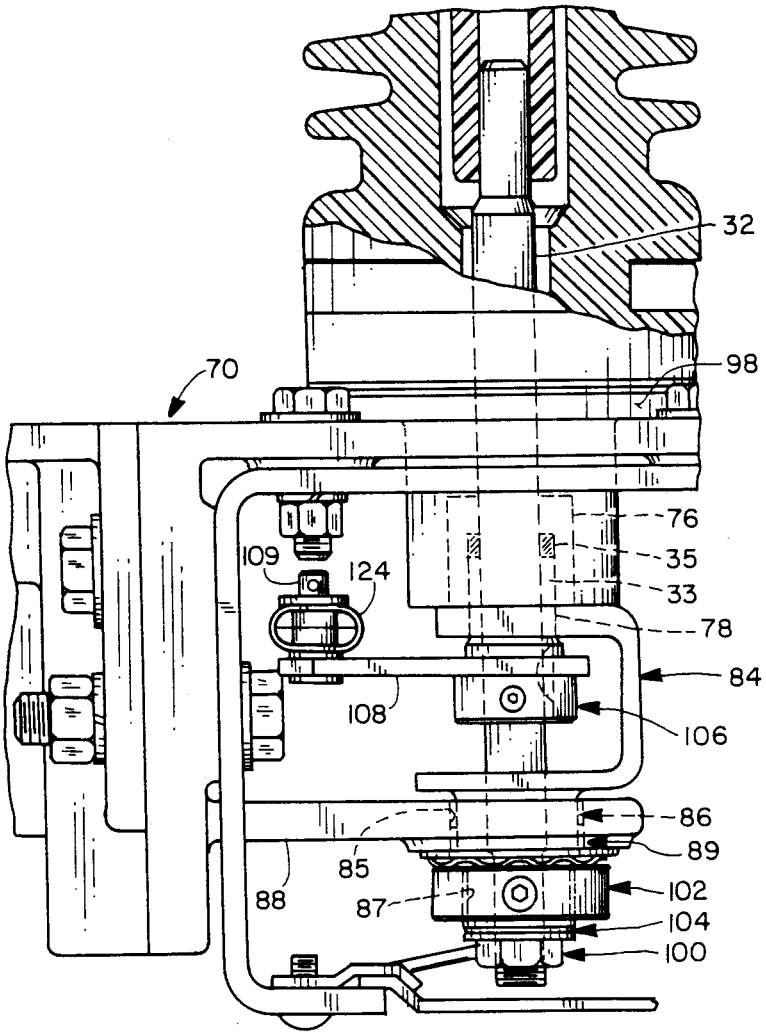
FIG. 3 is an enlarged view, partly in section, of a portion of the interrupter switch of FIG. 1.
Figure 4:
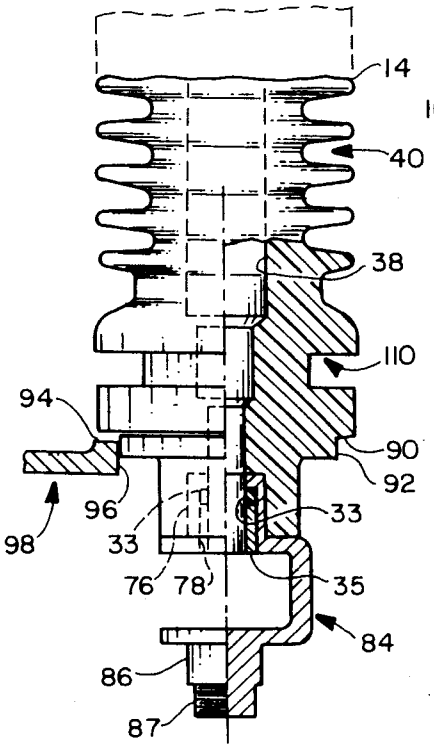
FIG. 4 is an enlarged view, partly in section, of a portion of the housing of FIGS. 1—3.

Specifically, the interrupter housing 14 (as best seen in FIGS. 3 and 4) is integrally molded to define a circumferential bearing surface 90 and a shoulder 92. The bearing surface 90 with shoulder 92 cooperate with respective bearing surfaces 94,96 of a bearing ring 98, either machined from or carried by the support base 70. The interrupter housing is also molded to define a circumferentially narrowed portion 110. An operating collar 112 is affixed about the portion 110 of the housing 14. The operating collar 112 includes a protruding pin 114. The interrupting housing 14 also includes an affixed C-shaped mounting member 84 with tubular portion 76 at the lower end of the vertical portion 40. Preferably, the tubular portion 76 is incorporated into the interrupter housing 14 during the molding process. The mounting member 84 includes a central bore 78. The operating member 32 extends through the bore 78 of the mounting member 76. Preferably, as illustrated in FIG.4, the sleeve bearing 33 and seal member 35 are inserted within the bore 78 of the tubular portion 76. The lower portion 86 of the mounting member 84 extends through a hole 85 of a support member 88 that extends from the support base 70. A bearing sleeve 89 is positioned within the hole 85 and about the lower portion 86. The lower portion 86 of the mounting member 84 includes a threaded portion 87. A fastening collar assembly 102 with suitable threads is affixed to the threaded portion 87.

The operating member 32 extends through the mounting member 84 and below the support member 88. The operating member 32 is threaded at the lower end thereof and receives a thrust washer 104 and a nut 100. A collar 106 is affixed to the operating member 32 intermediate the support member 88 and the tubular member 76. The collar 106 includes an operating lever arm 108 that extends from the member 32. A pin 109 protrudes from the operating lever arm 108. Accordingly, movement of the operating lever arm 108 about the axis 26 rotates the operating member 32. Preferably, the collar 106 is positioned over the member 32 after the interrupter housing is positioned on the support base 70 but before the member 32 is disposed through the support member 88.

Referring now additionally to FIG. 5, a three-pole group-operated interrupter switch configuration 120 is illustrated utilizing three of the interrupter switches 10 of FIGS. 1–4. The support base 70 of each of the interrupter switches 10 is affixed to a tubular support member 122, for example, via fasteners 123 as illustrated in FIG. 1. The operating lever arm 108 of each interrupter switch 10 via pin 109 is connected to an interrupter drive train referred to generally at 124 in FIGS. 1 and 5. For example, as illustrated by the bi-directional arrows 126 in FIG. 5, movement of the drive train 124 to the right opens the separable interrupting contacts 16,18 and movement to the left closes the separable interrupting contacts 16,18. The drive train 124 is operated at high speeds by an operator 128. The operator 128 is of the type which rapidly rotates an output shaft generally referred to at 130, for example, in the direction 132, to open or close the interrupters 12 of the interrupter switches 10. This type of operator 128 is often referred to as having "quick-make quick-break" capability in that the drive train 124 may be rapidly sequenced to the left, then to the right. Rapid closing of the separable interrupting contacts 16,18 is required to attain a desirable fault-closing capability. Rapid opening is required in the preferred embodiment to properly operate the puffer arrangement described in more detail hereinafter. The operator 128 receives control information at 134 to determine when the the shaft at 130 is to be rotated to open or close the interrupters 12. Operators of this type commonly use one or more springs to store energy; the spring or springs being charged via an electric motor or the like. In any case, the rotation in the direction 132 is translated via the interconnection linkage at 136 to movement either to the right or to the left by the drive train 124. For example, if the interrupters 12 are in the closed position, rotation of the drive shaft 130 will open the interrupters 12 by movement of the drive train 124 to the right in FIG. 5. Subsequent rotation of the drive shaft 130 results in closing of the interrupters 12 via movement of the drive train 124 to the left.

The pin 114 of the operating collar 112 of each interrupter switch 10 is connected to a disconnect drive link 138. The drive link 138 is driven by a disconnect control generally referred to at 140. As illustrated in FIG. 5, the disconnect control 140 may be stick operated—although, of course, in other embodiments, it could define a motor-driven output or a linkage for remote manual operation. The disconnect control 140 includes a crank arm 142 that is pivotally mounted at 144 and coupled to the drive link 138 via an interconnecting member 146 and a coupling 148 affixed to the drive link 138. Movement of the crank arm 142 provides corresponding movement of the drive link 138 to rotate the interrupter housing 14 of each of the interrupter switches 10 about their respective axes 26. Accordingly, if the interrupter switches 10 are each in the closed position as shown in FIGS. 1, 2, and 5, the crank arm 142 will be in the position as shown in FIG. 5. When the visible circuit-isolation position is desired, the crank arm 142 is moved downward to the left to the phantom position 142′ and the interrupter housings 14 are rotated to the phantom position 14′ such that the jaw contact 62 is disconnected and physically separated from the stationary contact pin 66. Correspondingly, movement of the crank arm 142 back to the position as shown in FIG. 5 results in the closing of the contacts 62,66. Thereafter, the separable interrupter contacts 16,18 may be closed to complete the circuit.

In order to ensure that the selective circuit-isolation function is achieved to open the disconnect contacts 62,66 only after the separable interrupting contacts 16,18 have been opened, a mechanical sequencing arrangement or interlock may be provided to either a) accomplish the opening of the separable interrupting contacts 16,18 before disconnect operation, or b) prevent disconnect operation until the interrupters are open. For example, in one specific embodiment a tripping link 155 is provided to sense movement of the crank arm 142 out of the closed position and to trip the operator 128 to open the interrupter 12. In addition, or as an alternative, a sensor switch 150 is positioned adjacent the crank arm 142 to sense when any movement of the crank arm occurs out of the closed position. The sensed condition by the switch 150 is connected via signal path 152 to the operator 128. Thus, if the separable interrupting contacts 16,18 of the interrupter switches 10 are closed and the crank arm is moved out of the closed position, the information from 152 will provide an indication to the operator 128 to open the interrupters 12 via the drive train 124. Additionally, a switch 151 is provided to indicate when the circuit-isolating disconnect arrangement is in the open position. The information from the switch 151 is utilized by the operator 128 to inhibit operation of the drive train 124. As illustrated in FIG. 5, in one arrangement, the switches 150,151 sense the position of cams 156,157 carried on a shaft 153 of the disconnect control 140.

Considering now additional features of the interrupter switch 10 and referring to FIGS. 1 and 2, the interrupters 12 are preferably filled with a gas such as SF6 or the like. In the preferred arrangement, the movable interrupter contact 18 includes a puffer piston arrangement referred to at 154 which cooperates with the walls of the cavity 34 to define a puffer cylinder. The movable contact 18 includes a nozzle 156 and communicating passages at 158 to permit the flow of gas through the contact 18 and over the contact 16 and the movable contact fingers 160 of the movable contact 18 during contact closing and opening. Communicating passages 53 and 55 are provided to permit a desirable degree of communication between the cavities 34 and 42 and the bore 38 for ease of filling with gas.

While there have been illustrated and described various embodiments of the present invention, it will be apparent that various changes and modifications will occur to those skilled in the art. For example, while a specific configuration of the interrupter 12 has been described for illustrative purposes, it should be understood that the present invention is also applicable to specific embodiments including a vacuum interrupter module in lieu of the puffer piston arrangement 154 and the interrupting contacts 16,18. It should also be realized that since the disconnect function is selective, the interrupter switch 10 can also be utilized and configured in a non-disconnect embodiment such that the support insulator 65 and the jaw contact 62 are eliminated with the first circuit terminal being directly connected to the end plate 60. Additionally, the interrupter housing 14 would be fixedly mounted to the support base 70 and the operating collar 112 eliminated. Accordingly, it is intended in the appended claims to cover all such changes and modifications as fall within the true spirit and scope of the present invention.

What is claimed and desired to be secured by Letters Patent of the United States is:

1. An electrical interrupter switch comprising:

means for interrupting current in a path between two circuit and for selectively thereafter providing additional circuit isolation via physical separation with respect to a first of the two circuit terminals, said interrupting means including separable interrupting contacts, means for separating said separable interrupting contacts, and means for electrically connecting each of said separable interrupting contacts to a respective one of the two circuit terminals, said electrical connecting means including means being selectively disconnectable and physically separable from the first of the two circuit terminals;

means for housing and supporting said interrupting means; and means independent of said separating means for moving said housing means as a movable switching member so as to perform said selective additional circuit isolation only after interruption of said current path.

2. The interrupter switch of claim 1 wherein said moving means comprises means for operating said separating means prior to movement of said housing means.

3. The interrupter switch of claim 2 wherein said moving means further comprises means for rotatably mounting said housing means about a predetermined axis.

4. The interrupter switch of claim 3 wherein said separating means comprises means rotatable with respect to said housing means for separating and connecting said separable interrupting contacts along a predetermined path.

5. The interrupter switch of claim 3 wherein said separating means comprises means rotatable with respect to said housing means about said predetermined axis.

6. The interrupter switch of claim 5 wherein said housing means is integrally molded from insulating material to define two portions that are arranged at a predetermined angle to each other.

7. The interrupter switch of claim 6 wherein said two portions of said housing means include predetermined receiving cavities.

8. The interrupter switch of claim 7 wherein said separable interrupting contacts are disposed within a first portion of said housing means and said rotatable means includes an operating member being disposed through said second portion of said housing means.

9. The interrupter switch of claim 8 wherein said separating means further comprises means for translating movement of said rotatable means to movement along said predetermined path.

10. The interrupter switch of claim 8 wherein said second portion of said housing means includes a predetermined integrally molded bearing surface.

11. The interrupter switch of claim 8 wherein said operating member extends out a first end of said second portion of said housing means, said rotatable means further comprising rotating sealing means disposed within said second portion of said housing means and cooperating with said operating member for providing sealing of said second portion and for guiding and supporting said operating member.

12. The interrupter switch of claim 11 wherein said housing means is filled with a gas.

13. The interrupter switch of claim 1 wherein a first of said separable interrupting contacts is movable and includes means for defining a puffer piston, said housing means being integrally molded to define a first receiving cavity forming a puffer cylinder by cooperation with said first of said separable interrupting contacts.

14. An interrupter switch which is operable to interrupt the current in a path between two circuit terminals and which is thereafter selectively operable to provide additional circuit isolation between the two circuit terminals, the interrupter switch comprising:

an unitarily molded housing including a first portion and a second portion extending from said first portion, said housing further including means for defining predetermined passageways and cavities, said defining means comprising a first passageway extending from a first end of said first portion to a point adjacent said second portion, said defining means further comprising a first cavity disposed in said second portion and a second cavity communicating between said first passageway and said second cavity;

means for interrupting the current in the path between the two circuit terminals, said interrupting means comprising a pair of separable interrupting contacts disposed within said first cavity, and electrical connection means for electrically connecting each of said separable interrupting contacts to a respective one of the two circuit terminals, said electrical connection means comprising disconnect means for providing a selectively separable connection to a first of the circuit terminals;

means for operating said interrupting means, said operating means comprising an operating member disposed through said first passageway and extending out said first end of said first portion, and means for translating rotation of said operating member to separation of said separable interrupting contacts; and means for rotating said housing about a predetermined axis extending through said first portion to operate said disconnect means only after operation of said interrupting means.

15. The interrupter switch of claim 14 further comprising means for rotatably mounting said operating member within said first portion and for sealing said first passageway at said first end of said first portion.

16. The interrupter switch of claim 15 wherein said operating member is fabricated from an insulating material.

17. The interrupter switch of claim 14 wherein said unitarily molded housing further comprises means for defining a bearing surface on said first portion for rotatably supporting said housing.

18. The interrupter switch of claim 14 wherein said first cavity defines a cylinder, said operating means further comprising means for moving a first of said separable interrupting contacts, said interrupting means comprising means carried by said first separable interrupting contact for providing a puffer piston adapted to cooperate with said cylinder.

* * * * *

UNITED STATES PATENT AND TRADEMARK OFFICE

CERTIFICATE OF CORRECTION

PATENT NO. : 4,983,792

DATED : January 8, 1991

INVENTOR(S) : Edward J. Rogers, et al

It is certified that error appears in the above-identified patent and that said Letters Patent is hereby corrected as shown below:

Col. 1, line 11, "rupter." should be -- rupter -- (delete period);

Col. 3, line 68, after "appropriate" insert -- rotation --;

Claim 1, col. 7, line 2, after "circuit" insert -- terminals --.

Signed and Sealed this

Twelfth Day of May, 1992

*Attest:*

DOUGLAS B. COMER

*Attesting Officer*

*Acting Commissioner of Patents and Trademarks*